US005960545A

United States Patent [19]

Shepherd et al.

[11] Patent Number: 5,960,545

[45] Date of Patent: Oct. 5, 1999

[54] UTILITY KNIFE WITH ROTARY BLADE MAGAZINE

[75] Inventors: Charles G. Shepherd, Oakville; Edward A. Funger, Burlington, both of Canada

[73] Assignee: The Nack Company Limited, Markham, Canada

[21] Appl. No.: 09/013,269

[22] Filed: Jan. 26, 1998

Related U.S. Application Data

[63] Continuation-in-part of application No. 08/694,126, Aug. 8, 1996, Pat. No. 5,727,320, which is a continuation-in-part of application No. 08/548,941, Oct. 26, 1995, Pat. No. 5,604,984.

[51] Int. Cl.[6] ..... B65B 1/10

[52] U.S. Cl. ..... 30/125; 30/162

[58] Field of Search ..... 30/125, 162, 335, 30/163; 266/355, 356

[56] References Cited

U.S. PATENT DOCUMENTS

| | | | |
|---|---|---|---|
| 1,436,751 | 11/1922 | Browning | 30/346.61 X |
| 2,785,489 | 3/1957 | Reise | 30/351 |
| 3,577,637 | 5/1971 | Braginetz | 30/162 |
| 4,103,421 | 8/1978 | Quenot | 30/162 |
| 4,209,900 | 7/1980 | Gilbert | 30/162 |
| 4,226,020 | 10/1980 | Quenot et al. | 30/162 |
| 4,233,734 | 11/1980 | Bies | 30/162 |
| 4,322,885 | 4/1982 | Osada | 30/162 |
| 4,794,693 | 1/1989 | Mayama et al. | 30/162 |
| 4,920,646 | 5/1990 | Grant | 30/162 |
| 5,042,184 | 8/1991 | Gilbert | 30/125 |
| 5,269,063 | 12/1993 | Okada | 30/162 |
| 5,435,062 | 7/1995 | Huang | 30/125 |
| 5,497,553 | 3/1996 | Chong | 30/162 |
| 5,502,896 | 4/1996 | Chen | 30/162 |

FOREIGN PATENT DOCUMENTS

| | | |
|---|---|---|
| 2696671 | 9/1992 | France . |
| 1522454 | 2/1977 | United Kingdom . |

*Primary Examiner*—Douglas D. Watts
*Attorney, Agent, or Firm*—Rogers & Scott

[57] ABSTRACT

A utility knife with a rotary blade magazine also has a safety catch carried by the blade transport mechanism. The safety catch has a manually engageable actuator moveable relative to the transport mechanism between operative and non-operative positions to prevent or permit respectively sliding movement of the transport mechanism in the housing. The knife further has an end cap removably and rotatably secured in the housing, and a rotatable and removable ratchet member adjacent a rear end of the magazine, the ratchet member being connected to the magazine whereby rotation of the ratchet member effects rotation of the magazine and having ratchet teeth engageable with ratchet recesses in the housing to enable the ratchet member to be clicked from one position to another. The end cap is connected to the ratchet member whereby rotation of the cap causes rotation of the ratchet member and subsequent rotation of the magazine.

7 Claims, 6 Drawing Sheets

UTILITY KNIFE WITH ROTARY BLADE MAGAZINE

BACKGROUND OF THE INVENTION

This application is a continuation-in-part of U.S. application Ser. No. 694,126 filed Aug. 8, 1996, now U.S. Pat. No. 5,727,320 issued Mar. 17, 1998, which is a continuation-in-part of U.S. application Ser. No. 548,941 filed Oct. 26, 1995, now U.S. Pat. No. 5,604,984 issued Feb. 25, 1997

This invention relates to utility knives with rotary blade magazines.

The knives described in the above mentioned patent and patent application have a manually holdable housing having a front end and a rear end, and a blade magazine removably mounted in the housing and rotatable about an axis parallel to a longitudinal axis of the housing extending from the front end to the rear end. The blade magazine has a series of radially and longitudinally extending circumferentially spaced blade-receiving slots for separately receiving thin blades having a cutting edge at at least one end thereof, each slot having an open front end to enable a blade therein to be removed from the magazine by forward movement through the front end of the slot.

The housing also carries a slidable transport mechanism having a manually engageable actuator projecting from the housing and slidable in a longitudinal direction between front and rear positions, the transport mechanism also having a blade-engaging arm within the housing, whereby positioning of the actuator at the forward position causes a blade carried by the arm to project from the front end of the housing in an operative position, and movement of the actuator from the forward position to the rear position causes the blade to be retracted from the operative position into the housing and into an empty slot in the magazine.

The magazine is rotatable to move the retracted blade from the arm of the transport mechanism and to position a new blade from another slot onto the arm for subsequent movement by the actuator to an operative position, It is an object of the present invention to provide improvements in the utility knives described in the above mentioned patent and patent application.

SUMMARY OF THE INVENTION

According to one aspect of the invention, a safety catch carried by the transport mechanism has a manually engageable actuator moveable relative to the transport mechanism between operative and non-operative positions to prevent or permit respectively sliding movement of the transport mechanism in the housing.

The knife may also have a moveable locking member having an inoperative position in which the locking member permits rotation of the magazine when the transport mechanism is in the rear position, and a locking position in which the locking member prevents rotation of the magazine when the transport mechanism is not in the rear position. The locking member may be moved from the inoperative position to the locking position by a spring acting between the housing and the locking member when the transport mechanism is not in the rear position. The locking member may be moved to the inoperative position by movement of the safety catch to its operative position when the transfer mechanism is in the rear position. The locking member, when in the operative position, may engage the magazine to prevent its rotation and also engage the cap to prevent its rotation. The locking member may be manually operable to enable the locking member to be moved manually from the locking position to the unlocking position to enable the cap to be rotated and removed when the transport mechanism is not in the rear position.

According to another aspect of the invention, the knife also has an end cap removably and rotatably secured in the housing, and a rotatable and removable ratchet member adjacent a rear end of the magazine, the ratchet member being connected to the magazine whereby rotation of the ratchet member effects rotation of the magazine and having ratchet teeth engageable with ratchet recesses in the housing to enable the ratchet member to be clicked from one position to another, and the end cap being connected to the ratchet member whereby rotation of the cap causes rotation of the ratchet member and subsequent rotation of the magazine.

DESCRIPTION OF THE DRAWINGS

One embodiment of the present invention will now be described, by way of example, with reference to the accompanying drawings, of which.

DESCRIPTION OF PREFERRED EMBODIMENT

Figure 11:
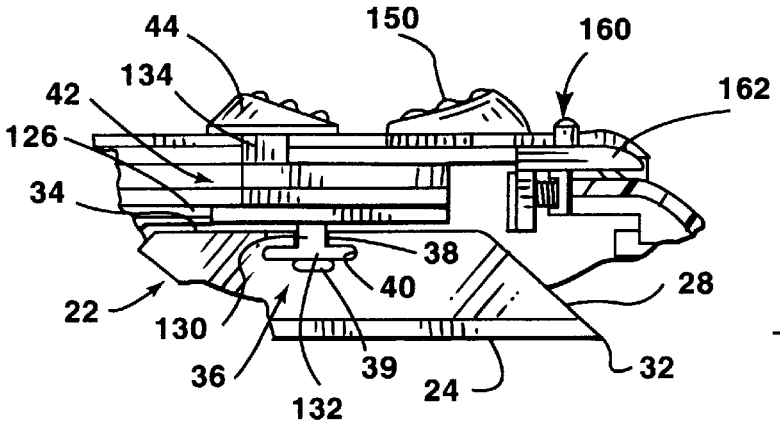
FIG. 11 is a fragmentary side view of the transport mechanism in the position shown in FIG. 8 but with the safety catch in the operative position.
Figure 9:
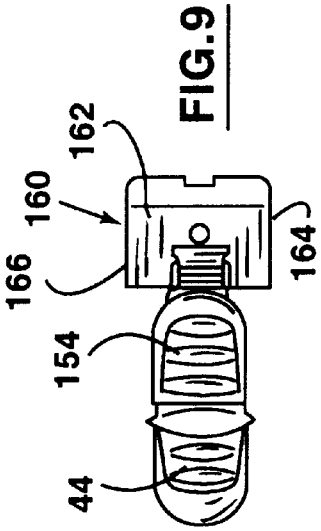
FIG. 9 is a top view of the manually-engageable actuator, the associated safety catch member and the magazine and end cap locking member.

Referring to the drawings, a utility knife 10 has a manually holdable housing 12 with a front end 14 and a rear end 16. A blade magazine 18 is removably mounted in the housing 12 and is rotatable about an axis parallel to the longitudinal axis of the housing 12 extending from the front end 14 to the rear end 16. The blade magazine 18 has a series of radially and longitudinally extending circumferentially spaced slots 20 for separately receiving thin blades 22, the slots 20 being open at both ends. The blades 22 have a trapezoidal body with (see especially FIGS. 8, 10 and 11) a lower cutting edge 24 which meets the inclined end edges 26, 28 to form sharp cutting points 30, 32 at each end. The upper blade edge 34 is parallel to the lower cutting edge 24. The upper edge 34 has a recess 36 midway along its length which extends into the body of the blade.

The recess 36 has a short initial straight portion 38 of relatively narrow width with parallel sides and a subsequent wider portion 40 at the inner end of the narrow portion 38. The wider recess portion 40 extends both forwardly and rearwardly beyond the narrow recess portion 38, and has upper and lower edges parallel to the upper and lower edges 34, 24 of the blade body. The recess 36 also has a further narrow portion 39 below the wider recess portion 40.

Figure 8:
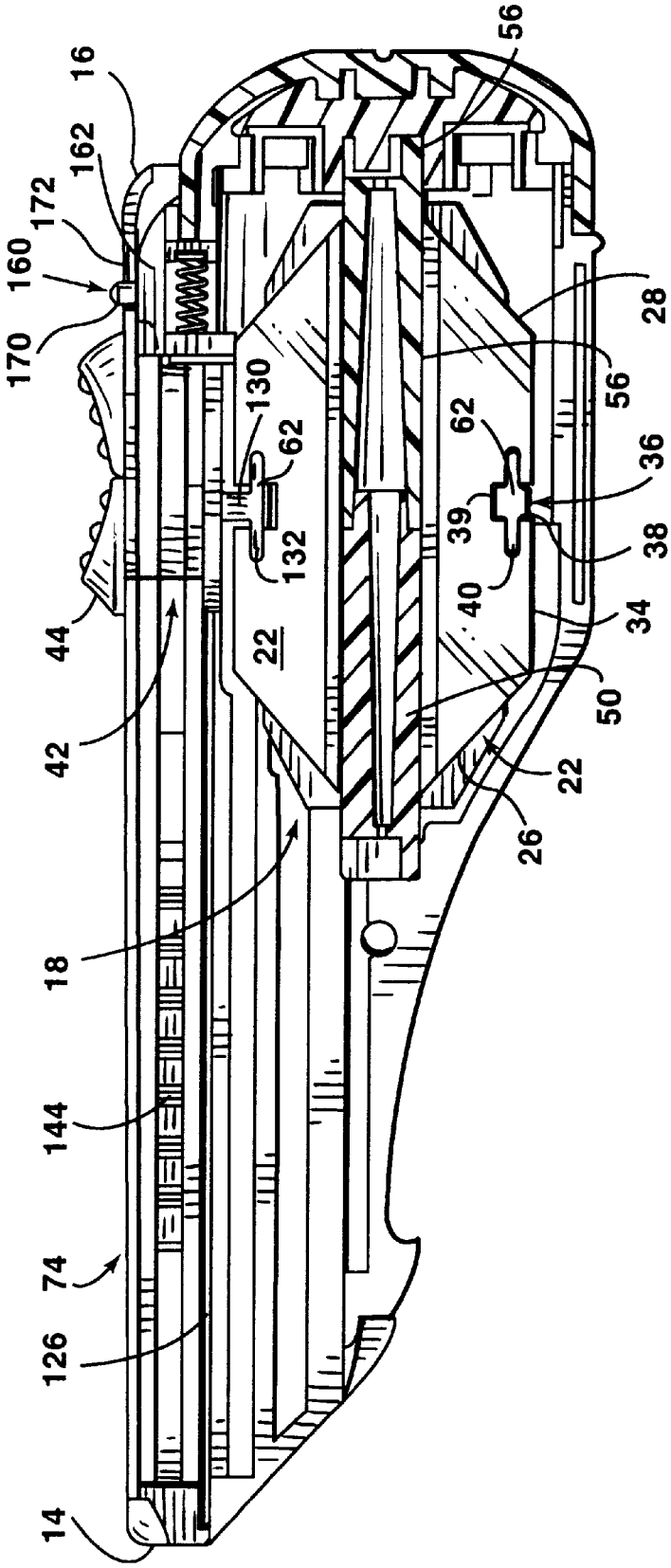
FIG. 8 is a longitudinal section view of the knife showing a blade in the magazine engaged by the transport mechanism.
Figure 10:
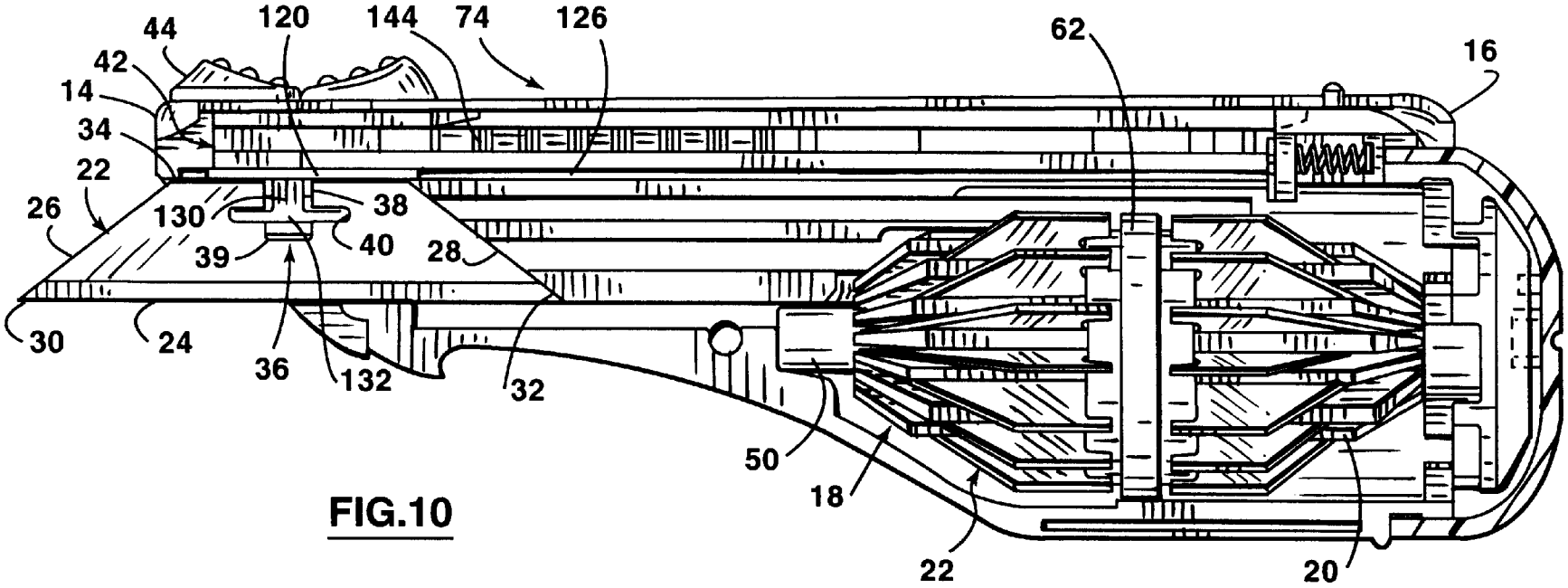
FIG. 10 is a similar view to FIG. 8 showing a blade moved forwardly to an operative position by the transport mechanism, with the magazine and blades therein being shown in perspective.

The housing 12 also carries a slidable transport mechanism 42 which has a manually engageable actuator 44 projecting from the housing 12 and slidable in a longitudinal direction between front and rear positions shown in FIGS. 8 and 10 respectively.

The blade magazine 18 has a rotatable body with two main parts 46, 48. The first part 46 has a shaft 50 with a series of radially and longitudinally extending circumferentially spaced slot-forming finger members 52. The finger members 52 extend in a longitudinal direction from the shaft 50 to the opposite end 54 of the first magazine part 46. The finger members 52 extend longitudinally beyond the shaft 50 and their free ends form the opposite end 54 of the first magazine part 46. The second magazine part 48 has a shaft 56 with a series of radially and longitudinally extending circumferentially spaced second slot-forming finger members 58 which extend in a longitudinally direction from the shaft 56 to the opposite end 60 of the second magazine part 58. The finger members 58 extend longitudinally beyond the shaft 56 and their free ends form the opposite end 60 of the second magazine part 48.

The first magazine part 46 is assembled with the second magazine part 48 by longitudinal movement of the first finger members 52 between the second finger members 58 to produce a blade receiving slot 20 between each adjacent pair of first and second finger members 52, 58. During assembly, the end portions of the finger members 52 of the first magazine part 46 slide over and are supported by the shaft 56 of the second magazine part 48. Similarly, the end portions of the second finger members 58 of the second magazine part 48 slide over and are supported by the shaft 50 of the first magazine part 46.

When the magazine 18 is fully assembled in this manner, the shaft 50 of the first magazine part 46 and the shaft 56 of the second magazine part 48 are interengaged, as shown in FIG. 8. Also, the finger members 52 of the first magazine part 46 have radially raised portions which extend beyond similar radially raised portions 59 of the finger members 58 of the second magazine part 48 to form a circumferential groove therebetween which extends substantially continuously around the magazine 18, i.e., interrupted by the slots 20, as more fully described in previously mentioned U.S. patent application Ser. No. 09/694,126. However, in this embodiment, the two magazine parts 46, 48 also form a blank portion 47 replacing what would otherwise be one of the slots 20.

The assembly of the magazine 18 is completed by a blade-retaining ring 62, the ring 62 having a circumferential gap 64. The cross-section of the ring 62 is shown more clearly in FIG. 8. The ring 62 is slid along the two assembled magazine parts 46, 48 from one end thereof until the ring 62 snaps into the previously mentioned circumferentially extending groove. The blades 22 are then loaded one at a time into the respective slots 20, with the blade-retaining ring 62 being moved to position the gap 64 in alignment with the blank magazine portion 47.

The upper end of each blade 22 projects slightly above the circumferential periphery of the magazine 18 and the retaining ring 62 passes through the recesses 36 in each blade 21, thereby holding the blades 22 in the slots 20 with their lower cutting edges 24 slightly spaced from the respective ends of the magazine 18. The blade-retaining ring 62 has radially outwardly projecting retainers 70 circumferentially spaced around the outer surface thereof.

Figure 1:
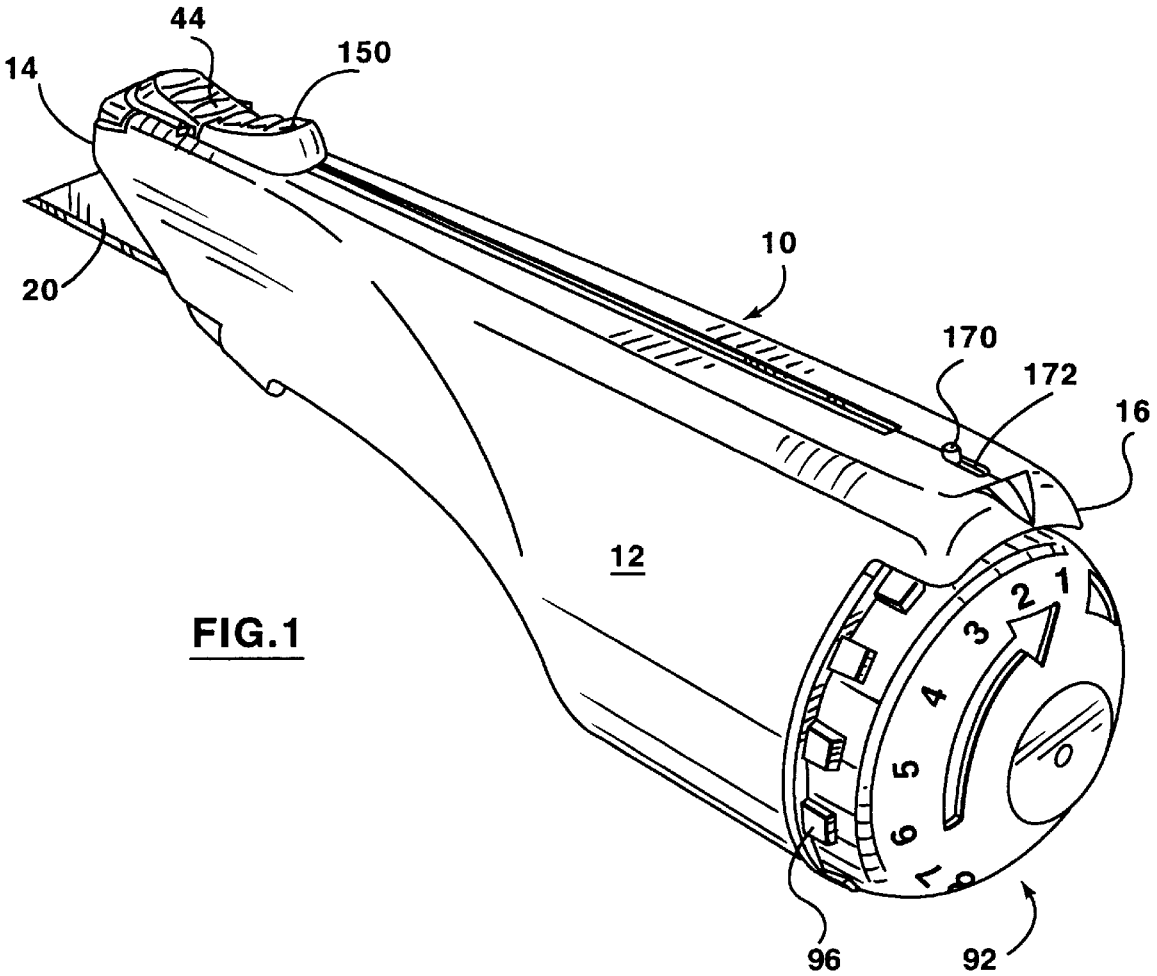
FIG. 1 is a perspective view of a utility knife in accordance with one embodiment of the invention.
Figure 3:
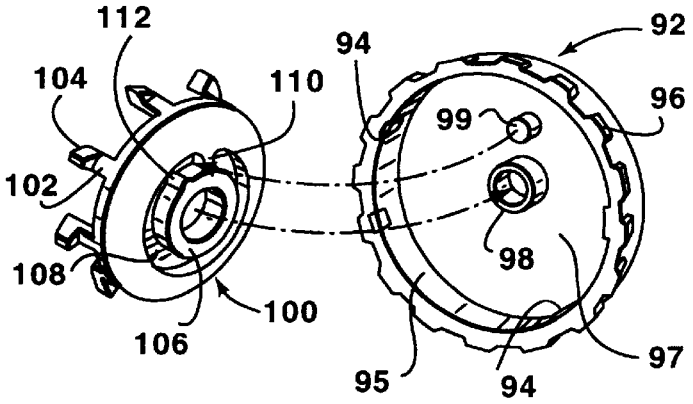
FIG. 3 is a perspective view of the end cap and the ratchet number.
Figure 2:
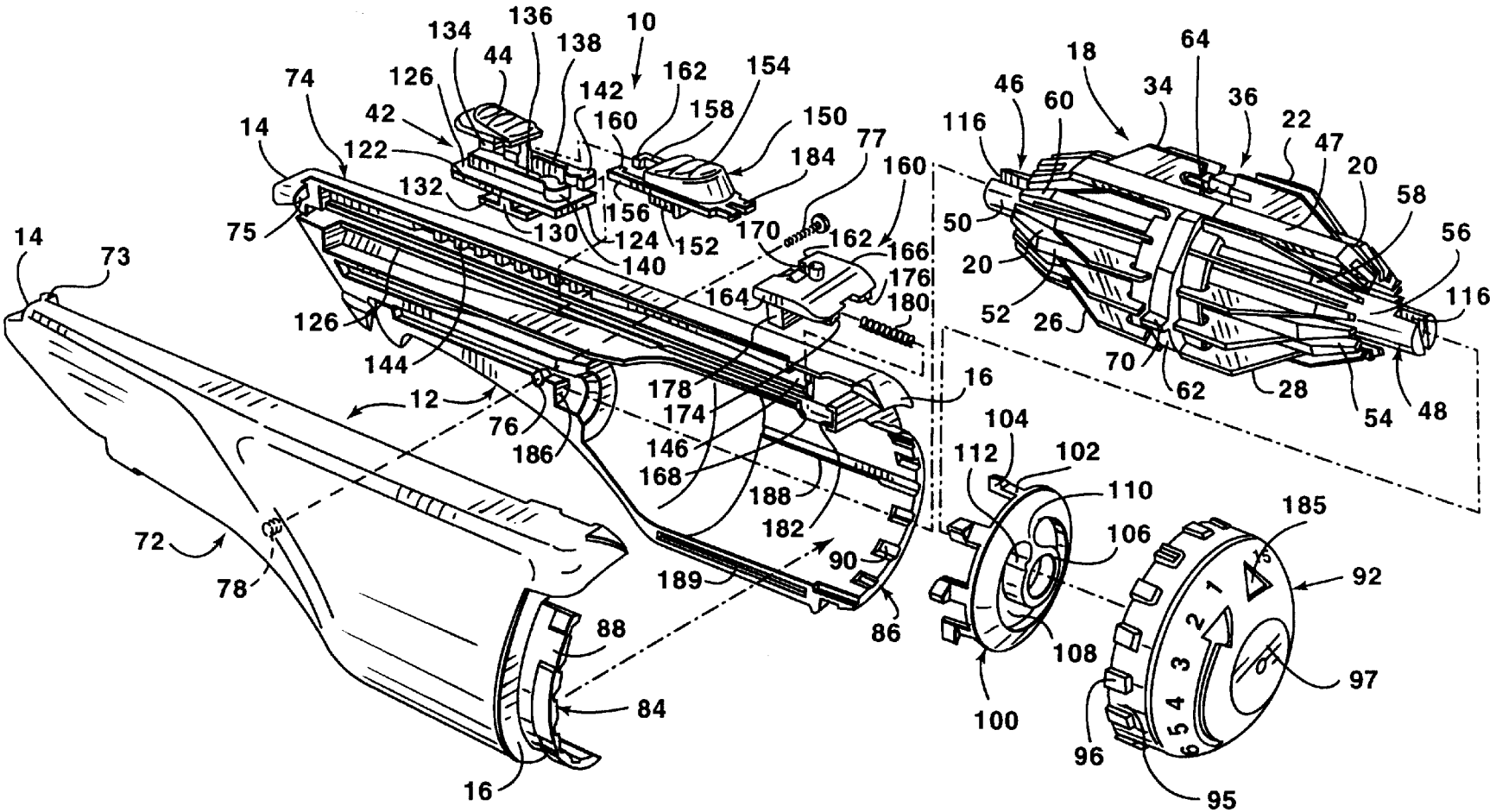
FIG. 2 is an exploded view of the knife of FIG. 1.
Figure 4:
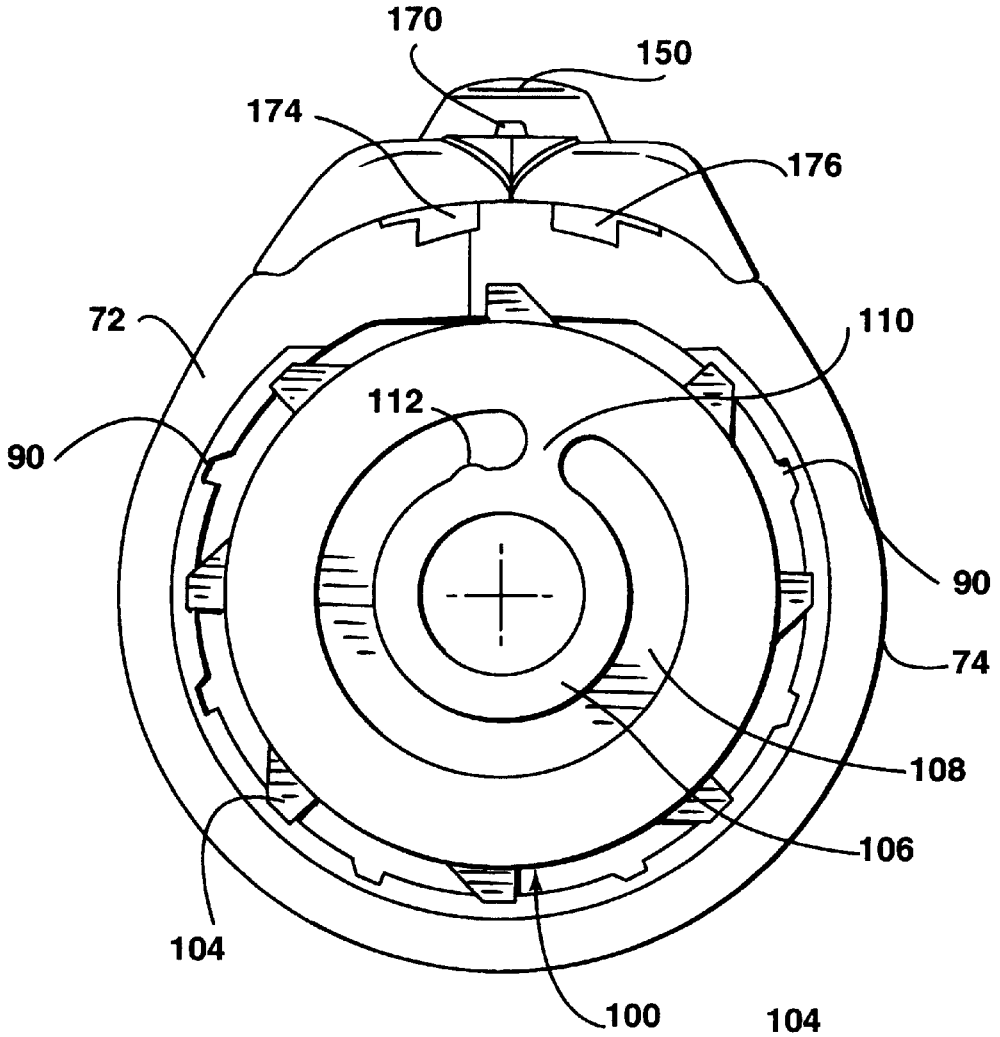
FIG. 4 is a rear view of the knife with the end cap removed and showing the rear face of the ratchet member.
Figure 5:
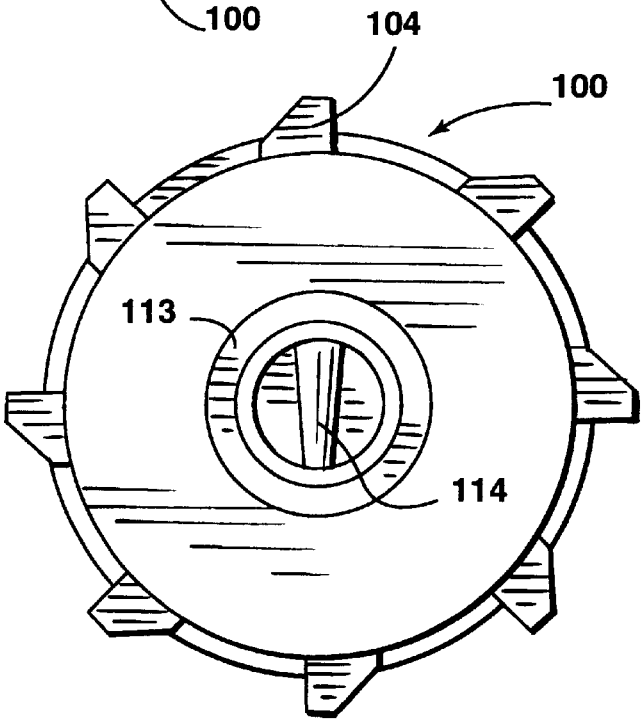
FIG. 5 is a front view of the ratchet member.
Figure 6:
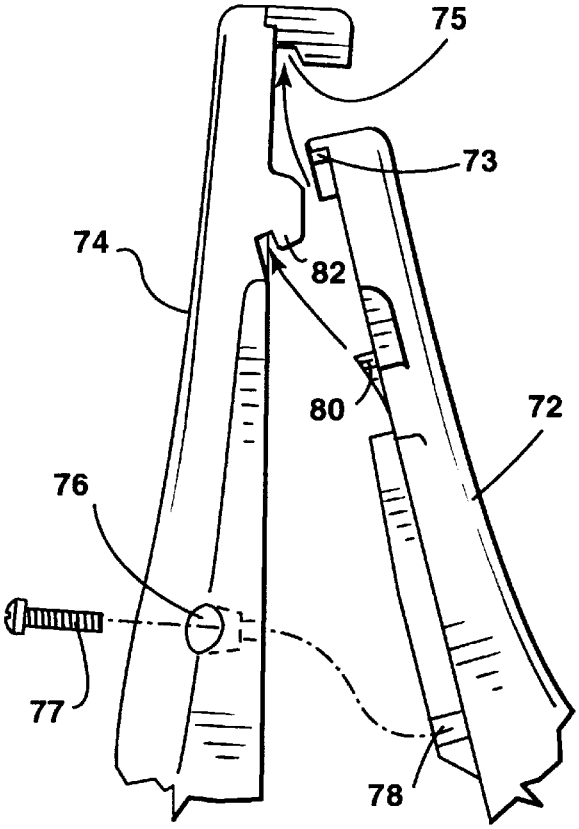
FIG. 6 is an exploded bottom view of the front end parts of the two housing portions showing the manner in which they are interlocked.
Figure 7:
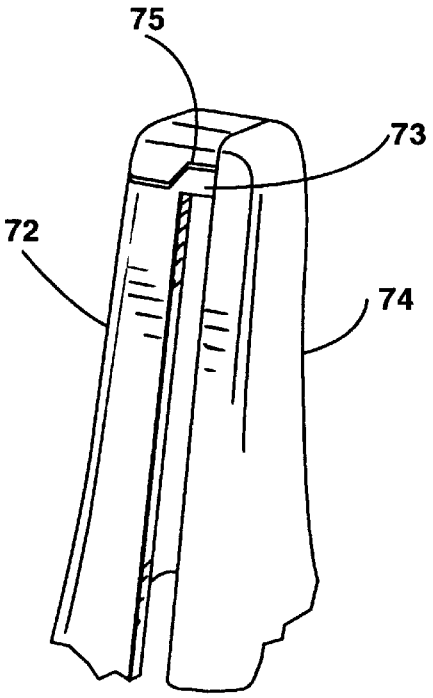
FIG. 7 is a top view of the front end parts of the housing portion showing the manner in which they interlocked.

The housing 12 is formed in two longitudinally separable portions 72, 74 as is clearly shown in FIG. 2. The housing portion 72 has a lateral projection 73 adjacent its front end 14 which engages in a recess 75 in the housing portion 74. Also, the housing portion 74 has an aperture 76 through which a retaining screw 77 passes to engage in a threaded recess 78 in housing portion 72 to hold the housing portions 72, 74 together. Also, the forward part of the housing portion 72 has a hook-shaped projection 80 on its lower edge which engages with a hook-shaped projection 82 on the edge of the forward part of the housing portion 74. The two housing portions 72, 74 are otherwise substantially mirror images of each other.

The rear ends of the housing portions 72, 74 have arcuate collar portions 84, 86 which combine to form a circumferentially extending collar which is open at the top. The external surfaces of the collar portions 84, 86 have circumferentially spaced radially outwardly extending rectangular projections 88 adjacent their rear edges, and the internal surfaces of the collar portions 84, 86 have circumferentially spaced recesses 90 to receive ratchet teeth, as will be described in more detail later.

A circular rear end cap 92 has internal radially inwardly extending rectangular projections 94 adjacent the front end of a circumferential wall 75 which extends forwardly from the periphery of a circular disc-like portion 97. When the cap 92 is being attached to or removed from the housing 12, the cap projections 94 can pass between the projections 88 on the collar portions 84, 86 only when the cap 92 is rotationally aligned with the housing 12 in a particular manner. The outer surface of the circumferential wall 95 of the cap 92 has a series of circumferentially spaced radially-outwardly extending projections 96 both for rotational locking and also for manual gripping. The forward face of the central cap portion 97 has a central cylindrical projection 98 and an eccentrically located stop member 99.

A circular ratchet member 100 has circumferentially spaced forwardly extending arms 102 which each carry a ratchet tooth 104, and has a rear face with a central hollow cylindrical projection 106 surrounded by an arcuate recess 108 which extends almost completely around the cylindrical projection 106, the arcuate recess 108 being interrupted by a stop portion 110. The outer wall of the cylindrical projection 106 has a protuberance 112 near the stop portion 110 on the anti-clockwise side thereof. The front face of the ratchet member 106 has a central cylindrical hollow projection 113 with a tapered alignment member 114 for engagement in a correspondingly shaped slot 116 in the end of each magazine shaft 50, 56.

The ratchet member 100 is located within the cap 92, with the cylindrical projection of the end cap 92 being a sliding fit in the hollow cylindrical projection 106 of the ratchet member 100 and with stop member 99 of the end cap 92 being located in the arcuate recess 108 of the ratchet member 100.

The transport mechanism 42 has a main body member 120 with side edges 122, 124 which slide along longitudinally extending slots 126 in the housing portions 72, 74. A leg 130 extends downwardly from the main body member 120 and has a blade carrier arm 132 at its lower end. The blade carrier arm 132 can move into the gap 64 in the blade retaining ring 62. A post 134 extends upwardly from the main body member 120 and carries the manually engageable actuator 44 at its upper end. A pair of laterally spaced resiliently deflectable arms 136, 138 extend rearwardly from the post 134 and are spaced slightly above the main body member 120. The arms 136, 138 have laterally outwardly extending projections 140, 142 at their rear ends for engagement in any one of a series of recesses 144 near the front of the housing portions 72, 74 and recesses 146 near the rear of the housing portion 72, 74.

A safety catch 150 associated with the transport mechanism 42 has a post 152 carrying a manually engageable actuator 154 at its upper end and a pair of laterally spaced resiliently deflectable arms 156, 158 extending forwardly from opposite sides of the post 152 at an approximately mid-height position thereon, the arms 156, 158 having inturned end portions 160, 162. A safety catch 150 is carried by the transport mechanism 42 in slidable engagement therewith so that the safety catch 150 can move forward and rearwardly relative to the transport mechanism 42. The arms 156, 158 of the safety catch 150 extend past opposite sides of the post 134 of the transport mechanism 42, with the inturned ends 160, 162 of the arms 156, 158 having been snapped past the front of the post 134 to retain the arms 156, 158 in slidable engagement with the post 134. The lower end of the post 152 of the safety catch 150 is located between the arms 136, 138 of the transport mechanism 42.

When the safety catch 150 is in the forward position relative to the transport mechanism 42, as shown in FIGS. 8 and 10, the post 152 of the safety catch 150 is adjacent to the post 134 of the transport mechanism 42 so that the free ends of the arms 136, 138 of the transport mechanism 42 can be resiliently deflected laterally inwardly towards one another by a small amount. This enables the transport mechanism 42 and the safety catch 150 to be moved between forward and rear positions in the housing 12 with the enlarged free ends 140, 142 of the arms 136, 138 of the transport mechanism 42 resiliently engaging the housing portions 72, 72 and snapping into the recesses 144, 146 to retain the transport mechanism 42 in various positions.

The safety catch 150 can be slid rearwardly relative to the transport mechanism 42 to position the post 152 of the safety catch 150 between the enlarged free end portions 140, 142 of the arms 136, 138 of the transport mechanism 42 so that the arms 136, 138 cannot be deflected inwardly towards one another. Thus, when the transport mechanism 42 is positioned with the enlarged free ends 140, 142 of the arms 136, 138 in one of the pairs of recesses 144, 146 and the safety catch 150 is moved to the rear position (shown in FIG. 11), the transport mechanism 42 cannot be moved forwardly or rearwardly because the enlarged free ends 140, 142 of the arms 136, 138 of the transport mechanism 42 cannot be deflected to enable them to leave the recesses 144, 146. The safety catch 150 can be released by moving it forwardly relative to the transport mechanism 42.

The utility knife 10 also has a magazine and end cap locking member 160 which is mounted for longitudinal sliding movement in the housing 12 adjacent to the rear end thereof. The locking member 160 has a main body portion 162 with opposite side edges 164, 166 slidably mounted in recesses 168 in the housing portions 72, 74. The main body portion 162 has a small upwardly extending post 170 which slides in a slot 172 in the housing 12 and projects slightly above the housing 12 so as to be manually engageable. The main body portion 162 also has a pair of laterally-spaced projections 172, 176 on its lower surface adjacent its rear end. The main body portion 162 further has a downwardly and transversely extending wall 178 adjacent its front end. The locking member 160 also has a spring 180 which acts between the wall 178 and a wall 182 in the housing 12 to resiliently urge the locking member 160 in a forward direction. Also, the front end of the upper surface of the main body portion 160 has a recess 182 which receives a projection 184 extending rearwardly from the post 152 of the safety catch 150, the projection 184 being in the same plane as the arms 156, 158.

To load the knife, the cap 92 is removed from the housing 12. It will be noted that the rear face of the cap 92 is marked with numbers from 1 to 15, with there being an arrowhead 185 between the numbers 1 and 15. The cap 92 can only be removed when the arrowhead 185 is at the top, i.e. at the twelve o'clock position, because it is only in this position that the projections 94 on the interior of the cap 92 can be slid between the projections 88 on the rear end of the housing. The ratchet member 100 will be removed with the cap 92.

A loaded magazine is then inserted into the rear end of the housing 12 with the blank portion 47 at the top, i.e. at the twelve o'clock position. The shaft 50 at the front enters into a recess 186 formed by the two housing portions 72, 74, and the retainers 70 on the blade-retaining ring 62 slide into slots 188 in the housing portions 72, 74 so that rotational movement of the blade-retaining ring 62 is prevented.

The ratchet member 100 is then fitted into the rear end of the housing 12 so that its cylindrical projection 112 slides over the magazine shaft 56 and its alignment member 114 fits (at a pre-determined rotational orientation) into the correspondingly shaped slot 116 in the magazine shaft 56. The cap 12 is then pushed onto the ratchet member 100 so that its cylindrical projection 98 enters the hollow cylindrical projection 106 on the ratchet member 100 and its eccentric pin member 99 enters the arcuate recess 108 in the ratchet member 100. The cap 92 is then rotated in a clockwise direction until the pin 99 snaps past the protuberance 112 in the arcuate recess 108 and engages the stop 110. The cap 92 will then be in the twelve o'clock position.

The transport mechanism 42 is then brought back to its rearmost position, if not already in this position, so that the blade carrier 132 is located in the gap 64 in the blade-retaining ring 62, and the safety catch 150 is moved to the rear position to lock the transport mechanism 42 in place. Movement of the safety catch 150 to the rear position also moves the magazine and cap locking member 160 rearwardly against the action of the spring 180. Such rearward movement of the locking member 160 moves its transverse wall 178 rearwardly beyond the rear ends of the blades 20 in the magazine 18, and also moves its projections 174, 176 rearwardly past the projections 96 on the cap 92, thereby permitting the magazine 18 and the cap 92 to rotate.

The cap 92 is then rotated to position the number "1" at the top, causing concurrent rotation of the ratchet member 100 by engagement of the pin 99 with the stop 110, with consequent movement of the ratchet teeth 104 from one recess 90 to another, that is to say with one "click". Such rotation causes the magazine (but not the blade retaining ring 62) to rotate by the same amount to position the first blade 20 on the blade carrier arm 132 of the transport mechanism 42. Since the safety catch 150 is in the rear position, the transport mechanism 42 cannot be moved forwardly.

To be able to move the transport mechanism 42 forwardly, the actuators 44, 154 are squeezed towards each other to move the safety catch 150 to its forward position relative to the transport mechanism 42. The enlarged free ends 141, 142 of the arms 136, 138 of the transport mechanism 42 can then leave the recesses 146. The transport mechanism 42, with the safety catch 150, is then slid forwardly with the blade 20 carried thereby until the front portion of the blade 20 projects from the front end of the housing 12. The extent of projection of the blade 20 is of course determined by the actual forward position of the transport mechanism 42, with the enlarged end portions 140, 142 of its arms 136, 138 snapping into an appropriate pair of recesses 144. The safety catch 150 is then moved rearwardly to lock the transport mechanism 42 in place.

When the transport mechanisms 42 and safety catch 150 are moved forwardly, the spring 180 moves the locking member 160 to its forward position where the transverse wall 178 prevents rotation of the magazine 18 and the projections 176 extend between the projections 96 of the cap 92 to prevent its rotation. Thus, rotation of the magazine 80 and cap 92 is not possible while the transport mechanism 42 and safety catch 150 are in a forward position.

After use or when the pointed end 30 of the blade 22 is blunt, the safety catch 150 is moved to the inoperative position by pushing it forwardly relative to the transport mechanism 42, and the transport mechanism 42 together with the blade 20 and safety catch 150 are slid back to the rear position so that the blade 22 is returned to its original slot 20 in the magazine 18, with the blade carrier member 130 once again being positioned in the gap 64 in the blade retaining ring 62.

The safety catch 150 is then moved to the operative position, i.e. rearwardly relative to the transport mechanism 42, to lock the transport mechanism 42 in place. The rearward movement of the safety catch 150 also causes its rearward projection 186 to engage the magazine and cap locking member 160 and move it rearwardly. The transverse wall 178 of the locking member 160 thus moves rearwardly clear of the blades 22 and the laterally spaced projections 174, 176 of the locking member 160 move rearwardly clear of the projections 96 on the end cap 92. The magazine 18 and the end cap 92 are thus now free to rotate.

When it is desired to use a new blade, the end cap 92 is then rotated by one notch clockwise to position the number "2" at the twelve o'clock position, with consequent rotational movement of the magazine 18 to move the used blade 22 off the blade carrier member 130 and position a new blade 22 thereon. The new blade 22 is then moved to the operative position in the same manner as previously described. Blade changing is repeated until the forward pointed ends 30 of all the blades 22 are blunted. The end cap 92 is then clicked from the 15 position to the position in which the arrowhead 185 is at the top. The cap 92 and ratchet member 100 are then removed, and the magazine 18 is removed and reversed so that the pointed ends 32 of the blades 22 can be used, the ratchet member 100 and end cap 92 being replaced as previously described. When all the pointed ends 30, 32 have been blunted, the magazine 18 is replaced by a new magazine 18 with new blades 22.

If the magazine 18 or the transport mechanism 42 becomes jammed while the transport mechanism 42 is in a forward position, i.e. not in the rear position, the safety catch 150 cannot be moved rearwardly to move the locking member 160 rearwardly to release the locking member 160 from the magazine 18 and the end cap 92, with the result that the end cap 92 cannot be rotated to position the arrowhead 185 uppermost and with the further result that the cap 92 cannot be removed. This problem can be overcome by manually engaging the pin 170 which projects upwardly through the slot 172 in the housing 12 and pushing the pin 170 rearwardly, thereby pushing the locking member 160 rearwardly to release it from the magazine 18 and end cap 92 in the same manner that the safety catch 150 would have done.

The advantages of the invention will be readily apparent to a person skilled in the art from the foregoing description of a preferred embodiment. Further embodiments will also be readily apparent to a person skilled in the art, the scope of the invention being defined in the appended claims.

We claim:

1. A knife comprising:

a manually holdable housing having a front end and a rear end, a blade magazine removably mounted in the housing and rotatable about an axis parallel to a longitudinal axis of the housing extending from the front end to the rear end, said blade magazine having a series of radially and longitudinally extending circumferentially spaced blade-receiving slots for separately receiving thin blades having a cutting edge at at least one end thereof, each slot having an open front end to enable a blade therein to be removed from the magazine by forward movement through the front end of the slot, said housing also carrying a slidable transport mechanism having a manually engageable actuator projecting from the housing and slidable in a longitudinal direction between front and rear positions, said transport mechanism also having a blade-engaging arm within the housing, whereby positioning of the actuator at the forward position causes a blade carried by the arm to project from the front end of the housing in an operative position, and movement of the actuator from the forward position to the rear position causes the blade to be retracted from the operative position into the housing and into an empty slot in the magazine, said magazine being rotatable to move said retracted blade from the arm of the transport mechanism and to position a new blade from another slot onto the arm for subsequent movement by the actuator to an operative position, and a safety catch carried by the transport mechanism and having a manually engageable actuator moveable relative to the transport mechanism between operative and non-operative positions to prevent or permit respectively sliding movement of the transport mechanism in the housing.

2. A knife according to claim 1 also including a moveable locking member having an inoperative position in which the locking member permits rotation of the magazine when the transport mechanism is in the rear position, and a locking position in which the locking member prevents rotation of the magazine when the transport mechanism is not in the rear position.

3. A knife according to claim 2 wherein the locking member is moved from the inoperative position to the locking position by a spring acting between the housing and the locking member when the transport mechanism is not in the rear position.

4. A knife according to claim 2 wherein the locking member is moved to the inoperative position by movement of the safety catch to its operative position when the transfer mechanism is in the rear position.

5. A knife according to claim 2 wherein the locking member, when in the operative position, engages the magazine to prevent its rotation and also engages the cap to prevent its rotation.

6. A knife according to claim 5 wherein the locking member is manually operable to enable the locking member to be moved manually from the locking position to the unlocking position to enable the cap to be rotated and removed when the transport mechanism is not in the rear position.

7. A knife comprising:

a manually holdable housing having a front end and a rear end, a blade magazine removably mounted in the housing and rotatable about an axis parallel to a longitudinal axis of the housing extending from the front end to the rear end, said blade magazine having a series of radially and longitudinally extending circumferentially spaced blade-receiving slots for separately receiving thin blades having a cutting edge at at least one end thereof, each slot having an open front end to enable a blade therein to be removed from the magazine by forward movement through the front end of the slot, said housing also carrying a slidable transport mechanism having a manually engageable actuator projecting from the housing and slidable in a longitudinal direction between front and rear positions, said transport mechanism also having a blade-engaging arm within the housing, whereby positioning of the actuator at the forward position causes a blade carried by the arm to project from the front end of the housing in an operative position, and movement of the actuator from the forward position to the rear position causes the blade to be retracted from the operative position into the housing and into an empty slot in the magazine, said magazine being rotatable to move said retracted blade from the arm of the transport mechanism and to position a new blade from another slot onto the arm for subsequent movement by the actuator to an operative position, an end cap removably and rotatably secured to the housing, and a rotatable and removable ratchet member adjacent a rear end of the magazine, the ratchet member being connected to the magazine whereby rotation of the ratchet member effects rotation of the magazine and having ratchet teeth engageable with ratchet recesses in the housing to enable the ratchet member to be clicked from one position to another, and the end cap being connected to the ratchet member whereby rotation of the cap causes rotation of the ratchet member and subsequent rotation of the magazine.

* * * * *